United States Patent [19]

Meyer

[11] 4,016,096

[45] Apr. 5, 1977

[54] METHOD AND DEVICE FOR CLOSING A RECEPTACLE FOR RADIOACTIVE WASTES

[75] Inventor: André Meyer, Le Plessis Robinson, France

[73] Assignee: Groupement pour les Activities Atomiques et Advancees "GAAA", Le Plessis Robinson, France

[22] Filed: Sept. 12, 1975

[21] Appl. No.: 612,963

[30] Foreign Application Priority Data

Oct. 2, 1974 France ..... 74.33190
Dec. 6, 1974 France ..... 74.30051

[52] U.S. Cl. ..... 252/301.1 W; 220/357; 220/358; 250/506; 250/507; 252/301.15

[51] Int. Cl.[2] ..... G21F 5/00

[58] Field of Search ..... 252/301.15; 220/357, 220/358; 250/506, 507

[56] References Cited

UNITED STATES PATENTS

| | | | |
|---|---|---|---|
| 3,116,767 | 1/1964 | Blin et al. | 250/506 |
| 3,567,066 | 3/1971 | Mansard | 220/358 |
| 3,578,203 | 5/1971 | Mainet | 220/358 |

*Primary Examiner*—Benjamin R. Padgett
*Assistant Examiner*—Deborah L. Kyle
*Attorney, Agent, or Firm*—Sughrue, Rothwell, Mion, Zinn & Macpeak

[57] ABSTRACT

The closing method comprises the installing, on the inside rim of the barrel, of a seal having multiple beads and, after filling, the applying of a first hollow lid driven into the barrel down to the level of the seal, then the installing of a conventional flat lid in overlying fashion. The seal can comprise two beads and may assume a U-shape. Application is possible to the transporting of any particularly toxical or radioactive substances.

4 Claims, 4 Drawing Figures

METHOD AND DEVICE FOR CLOSING A RECEPTACLE FOR RADIOACTIVE WASTES

BACKGROUND OF THE INVENTION

1. Field of the Invention

The present invention concerns a method for closing a receptacle for radioactive wastes and a device implementing the said method.

It concerns, more particularly, a method and a device for closing a receptacle making it possible to avoid the pollution of the outside surface of that receptacle when drawing up to a loading station.

2. Description of the Prior Art

It is known that the methods for disposing of radioactive wastes consist of placing these latter in fluid-tight barrels and then in burying them, for example, in the bottom of a mine which has fallen into disuse.

It is known also that the filling and the closing of these receptacles sets very acute pollution problems. To avoid the contamination of the loading premises, the following method is generally used: the receptacle to be filled is brought on a carriage into a handling room towards a fluid-tight chamber, then the carriage draws the receptacle up to the loading station. During that drawing up operation, the open barrel is connected in a fluid-tight manner to the isolated cell containing the radioactive wastes. The receptacle can then be filled without danger of contamination. then the isolated premises containing the radioactive wastes is closed up; the receptacle is disconnected from the isolated cell and it is closed. If, at that stage, the outside surface of the receptacle bears radioactive wastes, the loading room will be contaminated; that contamination will be propagated to the outside. It is therefore indispensable to draw up, fill and disconnect the receptacle with the certainty that none of the outside surfaces of the receptacle are or will be polluted.

The problem is, however, slightly simplified by the fact that users have generally come to an agreement to use only one type of receptacle constituted by a cylindrical barrel with a flat lid whose fluid-tight sealing is provided by means of a flat seal compressed between the upper thickness surface of the receptacle and the lid.

The inventor therefore concentrated on finding a method and a device making it possible to draw up, fill and close a standard receptacle having a flat seal while ensuring protection against the contamination of the outside surface of the receptacle.

SUMMARY OF THE INVENTION

The method according to the invention implements a device for closing a cylindrical barrel having two lids separated by an O ring having multiple beads.

According to the invention, two O rings having multiple beads can be implemented to great advantage:

An O ring having two beads whose radial cross-section resembles a question mark oriented towards the centre of the receptacle;

An O ring having multiple beads with a U-shaped cross-section, the latter allowing a greater tolerance at the time of the installing of the barrel with a view to drawing up.

According to the invention, the method for closing a cylindrical barrel for radioactive wastes during the loading thereof, implementing a device for closing the cylindrical barrel with two lids, an inside lid and an outside lid, separated by an O ring having multiple beads, is characterized in that it consists essentially:

Before lifting up the lid in arranging, on the top edge of the barrel, on the internal side, an O ring having multiple beads;

In covering the said ring with the inside lid;

After filling: in laying the inside lid again on the O ring having multiple beads;

In driving that lid inwardly below the top edge of the barrel;

In setting the second lid in position overlying the first lid on said top edge.

The present invention implementing the O ring having beads will be illustrated hereinbelow by the description of two examples of embodiments described.

DESCRIPTION OF THE PREFERRED EMBODIMENTS

Figure 1:
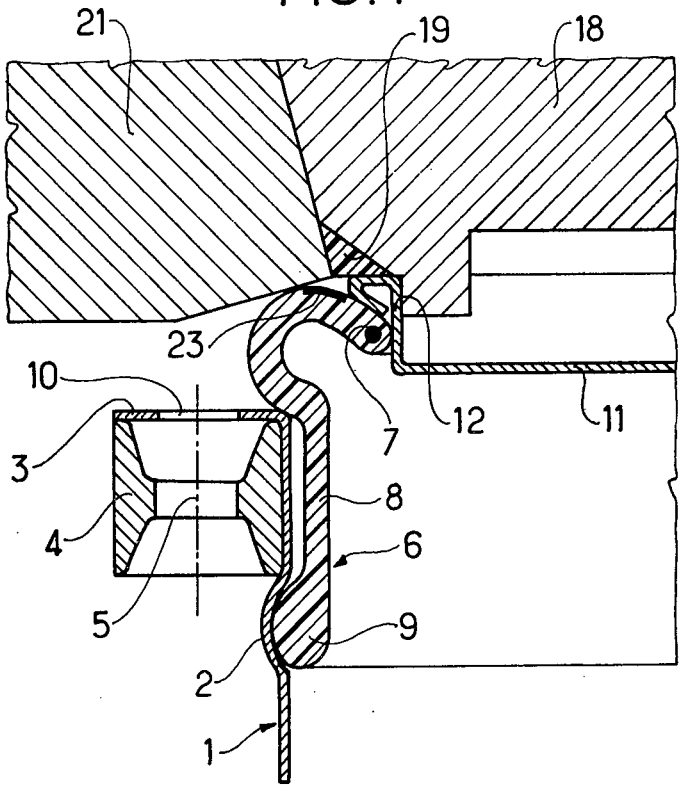
FIG. 1, is a vertical, sectional view of one embodiment of the present invention involving an O ring having two beads and whose radial cross section resembles a question mark.

FIG. 1 makes it possible to understand the configuration of the barrel and the position of a ring seal 6 having two beads at the time of the drawing up. The cylindrical barrel to be filled comprises a wall 1 provided with circular bosses such as 2 and is ended at its top part in the form of a flange or a right-angled, angle iron 3. A binding 4 in the form of a hoop provided vertically with circular openings such as 5 corresponding to similar openings 10 formed in the right-angled angle iron 3 is arranged on the outside of the barrel between the angle iron 3 and the boss 2. The O ring 6 having a double bead is placed so as to bear against the inside rim of the angle iron 3. Its cross-section in the shape of a question mark turned inwards comprises a top part 7, forming the top bead which is at least partly hollowed and fulfills an important function in the fluid-tight sealing of the device. The body 8 of the O-ring seal 6 is extended at its bottom part by a second bead 9 which bears against the boss 2, thus ensuring the seating of that seal. The seal 6 is made of elastomer of any type.

The light lid 11 formed by a fairly thin wall circular plate ended by an angle iron 12 having a triangular cross-section whose end part rests flat on the seal 6 is arranged on that seal.

Figure 2:
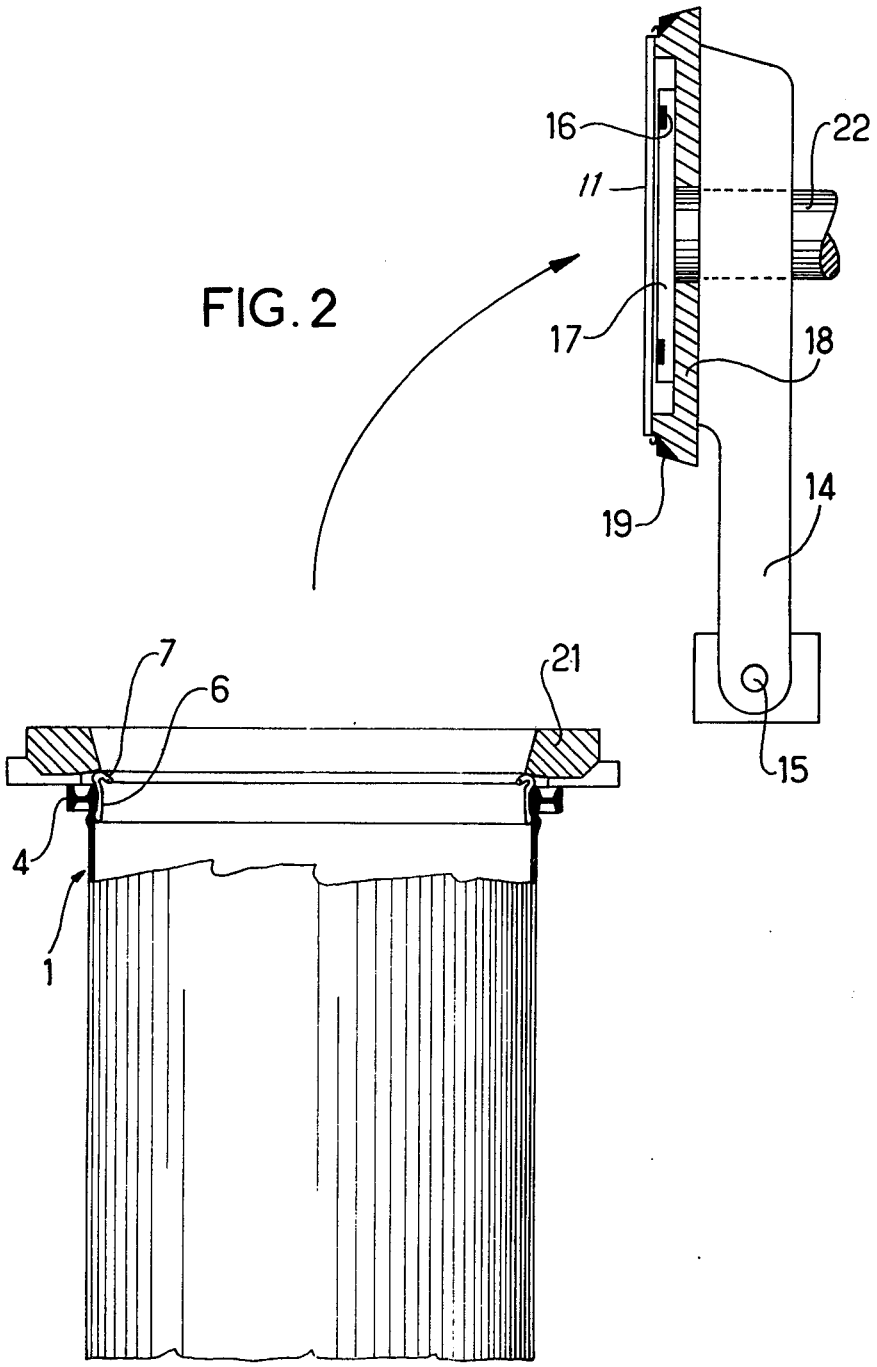
FIG. 2 is an elevated viewing showing the opening of the receptacle of FIG. 1 in the case of the O ring having two beads at the time of drawing up.

On referring to FIG. 2, a drawing up or lifting arm 14, mobile about an axis 15, provided with a gripping means 16 borne by the piston 17 will be seen. This gripping means 16 can be constituted by a magnetic element inserted in the front face of the piston 17. The drawing up arm 14 is equipped with a lid-bearer 18 for fluid-tight sealing fitted with a seal 19. Moreover, a ring 21 integral with the isolated cell is applied against the seal having a double bead 6. By means of the sliding arm 22, the piston 17 moves gently downwards and comes into contact with the light lid 11. The latter is attracted by the magnetic element 16 and the angle iron 12 provides fluid-tight sealing by means of the O ring 19. The result of this is that hereafter, the top of the lid 11 will be protected from all contamination. The drawing up arm rises, lifts lid 11 and unblocks the supplying of the barrel with radioactive wastes (not shown). When the receptacle is full, the drawing up arm lowers again and the lid 11 comes into contact with the O ring having beads. The piston 17 presses on the light lid 11, and pushes it in, squashing the seal having two beads. During that movement, the only part 23 of the seal 6 which could possibly be contaminated is drawn downwardly by the angle iron 12 of the lid 11 towards the inside of the receptacle. The lid 11 is then sufficiently blocked by the seal 6 for the piston 17 to be able to retract without moving the lid.

Figure 3:
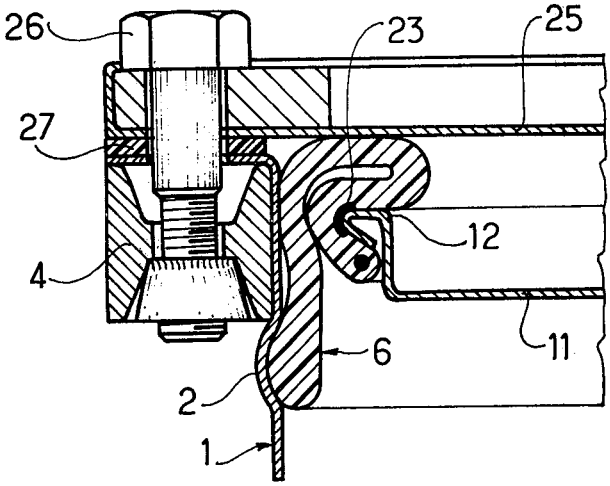
FIG. 3 is a partial sectional view showing the double lid closed in the same case.

FIG. 3 shows the position taken up by the various parts when the top lid 25 is set in position overlying lid 11 and the fixing bolts 26 of the lid 25 are screwed up. It will be seen that the seal 6 is placed completely below the lid 25 and ensures extra fluid-tight sealing by co-operating with the light cover or lid 11. The part 23 which could possibly be contaminated is covered by the angle iron 12 of the lid 11. The flat seal 27 which has not been in contact with the radioactive wastes is not at all contaminated. Moreover, the bearing surfaces of that flat seal have not been contaminated.

It will be seen therefore that finally, the seal 6 and the inside lid 11 completing the equipment of the barrel make it possible, at a very slight expense, to obtain the following results:

the ensuring of fluid-tight sealing, at the time of drawing up, between the receptacle and the double lid system;

the ensuring of fluid-tight sealing between the inside lid and the receptacle;

the ensuring of its own immobilization in the receptacle;

the ensuring of covering for the contaminated part of the outside face of the seal having two beads and for the top surface of the inside lid 11 at the time of the driving of the latter into the receptacle.

Nevertheless, this device implementing an O ring having two beads can comprise a few disadvantages: its flexibility in the transversal direction is directly a function of its thickness. That seal therefore does not allow substantial decentering of the axis of the barrel in relation to the axis of the circular opening of the radioactive premises.

The result of this is a certain loss of time during the positioning of the barrel with a view to drawing up, as well as technical complication.

To overcome these disadvantages, the inventor has improved another type of seal which will be designated hereinbelow by the name of "a U-shaped O ring having multiple beads." Its particular U-shaped cross sectional structure enables a greater tolerance at the time of the positioning of the barrel with a view to drawing up. Such an arrangement makes it possible to effect the positioning of the barrel at a greater speed.

Figure 4:
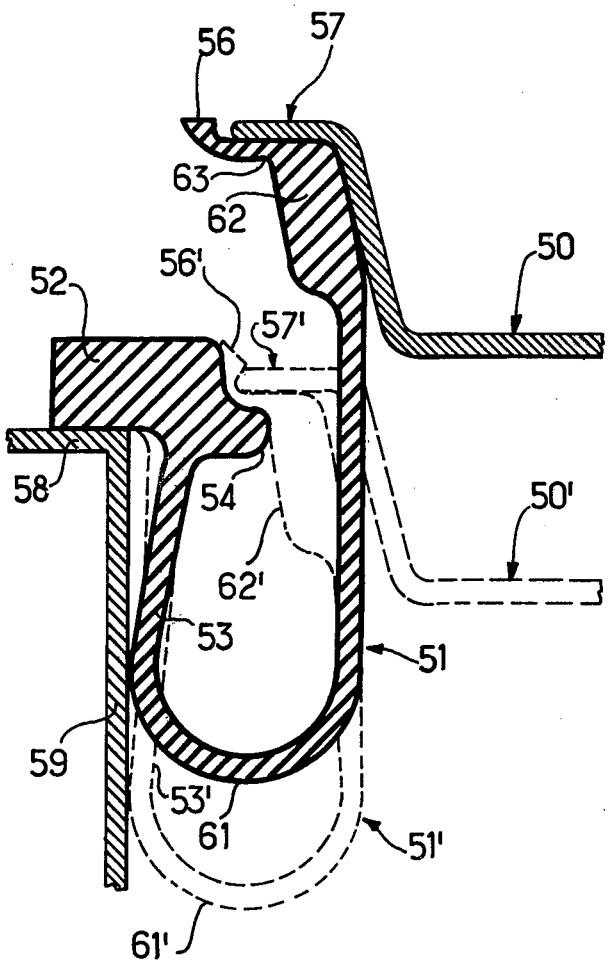
FIG. 4 is a partly cutaway view of an O ring having multiple beads with a U-shaped cross-section employed in a second embodiment of the invention.

FIG. 4 makes it possible to understand better the advantages of such a U-shaped seal.

The seal 51 thus described in the figure is shown in a cutaway view; the top bead is shown pressed against a part of the rim 58 of the barrel 59. As shown in the figure, the seal comprises a certain number of elements fulfilling distinct functions all combining to provide fluid-tight sealing for the barrel.

The bead 52 of the seal is thick and comprises, at the back, a flange 54. The bead 52 ensures fluid-tight sealing between the rim 58 and the top lid (not shown).

The flange 54 of the bead 52 comprises, at its top part, a hollowed out part contingently enabling removal of the inside lid 50 and contributes to ensuring fluid-tight sealing when the seal is squashed.

The part 53 of the seal, bearing, as soon as it is installed, on the inside face of the wall 59 of the barrel, ensures the stability of the part of the seal which is originally not supported.

The part 61 having the shape of a U loop open at the top ensures the flexibility of the part of the seal supporting the inside lid and ensures the positioning of the said lid in the case of the misalignment of the circular opening of the barrel and of the circular opening of the premises containing the radioactive wastes.

The inside bead 62 co-operates with the part 61 of the seal to ensure the centering and the fluid-tight sealing of the inside lid.

The part 63 comes into contact with the flange 54 on the final closing of the light lid 50'.

It contributes to the trapping in the loop thus formed of any radioactive pollutions which may have entered the concave part of the seal during the loading of the barrel.

The top bead radially outwardly extending tail portion 56 of the seal is wound partly in position 56' round the end 57 of the lid, bearing against the bead 52 of the said seal. The broad contact which is thus formed, when the bottom lid 50 has gone down to 50' both between the seal and that lid 50' and between the two beads of the seal coming into contact, considerably increases sealing between the volume situated hereinafter in the barrel and the volume comprised between the two lids. In this way, the top lid no longer provides anything than extra fluid-tight protection and ensures, due to its thickness, essentially a mechanical protection.

The seal thus experimented is made of a synthetic elastic product; the U-shaped part of the seal has a thickness of about 3 mm. It is thus possible to effect decanting of the radioactive products in the barrel despite a substantial misalignment of the barrel in relation to the circular opening of the premises containing the radioactive products. The sealing measured after the complete closing of the barrel is found to be completely satisfactory.

An application is found for such a device designed specially for the burying of radioactive wastes in all cases where it is required to transport toxical products and where it is advisable to avoid even partial contamination of the receptacle handling room.

The lid can contingently be provided with a vent having a suitable filter, allowing the escaping of gas from the receptacle.

Although the device which has just been described may appear to afford the greatest advantages for implementing the invention, it will be understood that various modifications tending to replace an element of the invention by an element fulfilling the same technical functions in certain particular cases, can be effected without going beyond the scope of the invention.

I claim:

1. A method for closing a cylindrical barrel for holding radioactive waste during the loading thereof, said barrel including an inside lid and an outside lid separated by an O-ring having two beads, said method comprising:

arranging on the top rim of the barrel, on the internal side thereof, said O-ring with beads at upper and lower positions said beads facing respectively towards and away from the interior of said barrel;

resting the inside lid on the upper bead bringing said O-ring into contact with an annular waste discharge port external of said inside lid;

orienting said barrel coaxially beneath the waste discharge port for waste discharge thereinto;

lifting said inside lid axially from said O-ring and said annular ring and filling said barrel with said waste;

resting the inside lid again on said O-ring upper bead;

driving said inside lid and said upper bead downwardly toward said lower bead below the level of said top rim such that any surface portion of said O-ring seal between said beads subjected to possible radioactive contamination during waste loading of said barrel is blocked from exposure to the barrel exterior; and installing the outside lid on said barrel rim overlying said inside lid.

2. The method as claimed in claim 1, wherein said step of driving said inside lid and said upper bead downwardly below said top rim includes the step of doubling said 0-ring over on itself such that a portion of said O-ring intermediate of said upper and lower beads overlies the upper edge of said inside lid to insure that any portion of said O-ring possibly contaminated by radioactive waste during loading is sealed by said inside lid during driving of said inside lid and said upper bead downwardly below the top rim of said barrel.

3. A double lid barrel closure assembly for a cylindrical barrel receiving radioactive waste and the like, said assembly comprising:

a circular boss formed within said barrel extending about the circumference of said barrel below the barrel rim and being concave radially inward of the barrel, an O-ring seal of question-mark configuration in cross section mounted on the radially inner surface of the barrel, facing inwardly of said barrel and formed with upper and lower beads, said lower bead being received within said circular boss and said upper bead extending above the rim of said barrel and having a body portion extending along the inner wall of the barrel between said circular boss and said rim, said upper bead having a terminal portion turned down toward the inside of the barrel, a light circular lid terminating at its peripheral edge in an angle iron of triangular cross section, said lid having a diameter slightly less than that of the barrel and having an inclined edge of said angle iron in contact with the turned down terminal portion of said upper bead, said circular lid being driven into said barrel to a depth below the rim of said barrel and to effect doubling of said O-ring on itself so as to partially overlie the upper edge of the angle iron to seal possibly contaminated portions of said seal intermediate of said beads, a flat circular seal arranged on the rim of said barrel, and an outside lid fixed to said barrel rim and overlying said inside lid.

4. In a double lid barrel closure assembly for the fluid-tight closing of a clyindrical barrel receiving radioactive waste and the like during the loading thereof including inside and outside lids separated by an O-ring seal mounted on the top rim of the barrel on the internal side thereof, and wherein the inside lid rests on the O-ring but is lifted therefrom during filling of the barrel with said waste, the inside lid is again rested on the O-ring and driven downwardly inside the barrel prior to installing of the outside lid on the barrel in overlying fashion with respect to the inside lid, the improvement wherein:

said O-ring seal is U-shaped in cross section, oné end being provided with a radially inside bead and the other end being provided with a radially outside bead, said outside bead bears on a circular rim of the barrel, said outside bead includes a radially inwardly projecting flange facing the inside bead and formed below the upper face of said outside bead, said inside bead terminating in a radially outwardly directed tail portion, said inside lid includes an oblique peripheral edge portion and is of a diameter such that the oblique peripheral edge portion rests on said inside bead, and after closing of the inside lid by pushing said inside lid downwardly into the interior of said cylindrical barrel and below said barrel rim, said inside bead including said tail portion bears against the flange of said outside bead to effectively seal any possibly contaminated area of said U-shaped seal intermediate of said multiple beads which is contaminated during loading of said cylindrical barrel with said radioactive waste or the like.

* * * * *

UNITED STATES PATENT AND TRADEMARK OFFICE

CERTIFICATE OF CORRECTION

PATENT NO. : 4,016,096

DATED : April 5, 1977

INVENTOR(S) : Andre Meyer

It is certified that error appears in the above-identified patent and that said Letters Patent are hereby corrected as shown below:

IN THE HEADING:

Correct the name of the Assignee to read as follows:

--- Groupement pour les Activites Atomiques et Avancees "GAAA" ----

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*